US006173683B1

(12) United States Patent
Nemoto et al.

(10) Patent No.: US 6,173,683 B1
(45) Date of Patent: Jan. 16, 2001

(54) TWO-STROKE CYCLE ENGINE

(75) Inventors: Toshihisa Nemoto; Terutaka Yasuda, both of Tougane (JP)

(73) Assignee: Maruyama Mfg. Co., Inc. (JP)

( * ) Notice: Under 35 U.S.C. 154(b), the term of this patent shall be extended for 0 days.

(21) Appl. No.: 09/409,265

(22) Filed: Sep. 30, 1999

(30) Foreign Application Priority Data

Jan. 4, 1998 (JP) ..... 10-104200
Jul. 15, 1999 (JP) ..... 11-201065

(51) Int. Cl.[7] ..... F02B 33/04
(52) U.S. Cl. ..... 123/73 PP
(58) Field of Search ..... 123/73 PP, 73 AA, 123/73 A

(56) References Cited

U.S. PATENT DOCUMENTS 4,178,886 * 12/1979 Uchinishi ..... 123/73 A
4,708,100 * 11/1987 Lou ..... 123/73 PP
4,934,345 * 6/1990 Fukuoka et al. ..... 123/73 PP
5,628,295 * 5/1997 Todero et al. ..... 123/73 AA

* cited by examiner

*Primary Examiner*—Willis R. Wolfe
*Assistant Examiner*—Hyder Ali
(74) *Attorney, Agent, or Firm*—Perkins Coie LLP

(57) ABSTRACT

A two-stroke cycle engine having an improvement of its power output while reducing total hydrocarbons in the exhaust gases. The two-stroke cycle engine comprises a crank chamber adapted to receive a fuel mixture through feed means and a combustion chamber in a cylinder. Scavenging ports are provided for communication between the combustion chamber and the crank chamber to transfer the fuel mixture from the crank chamber to the combustion chamber while a exhaust port is provided for exhausting the burned gases from the combustion chamber. Reciprocation of the piston results in increase or decrease in volume of the combustion chamber while opening or closing the exhaust port and the scavenging ports. Communication means are provided for communicating the exhaust port with the crank chamber via the scavenging ports to draw a portion of the burned gases from the exhaust port into the crank chamber when the piston is in its top dead center.

6 Claims, 5 Drawing Sheets

TWO-STROKE CYCLE ENGINE

BACKGROUND OF THE INVENTION

This invention relates to two-stroke cycle engines adapted for use of bush cutters, hedge trimmers, or the like, and more particularly, to a two stroke cycle engine which can achieve an improvement of combustion efficiency as well as reduction in total hydrocarbons in exhaust gas.

Such a two stroke cycle engine has been designed such that all the charging, scavenging and exhausting permit replacement of gases with high efficiency to provide a high power output. However, due to the fact that the scavenging and exhausting occur simultaneously, fuel mixture introduced through scavenging ports into a combustion chamber escapes into the exhaust port and this causes an increase in total hydrocarbons in the exhaust gas. In addition, after the fuel mixture has been burned in the combustion chamber, the burned gases are exhausted through the exhaust port with some unburned gas contained therein and this also causes an increase in total hydrocarbons in the exhaust gases. To reduce the total hydrocarbons in the exhaust gases, measures may, therefore, be adopted for preventing the fresh fuel mixture from escaping into the exhausting port and for increasing the combustion efficiency. Due to increase in combustion efficiency, total hydrocarbons in the exhaust gas can be reduced while improving the power output.

For purposes of preventing escape of the fuel mixture, scavenging flow of the gases has been improved by changes in positions and configurations of the scavenging and exhaust ports, and a shape of the combustion chamber has been modified to increase the combustion efficiency, but such improvements of the scavenging flow and the combustion efficiency have their limitations. It has also been proposed hitherto to make smaller an angle of rotation of the crankshaft through which the exhaust port opens, in order to decrease an amount of escaping fresh fuel mixture and slightly increase a residue of the burned gases in the combustion chamber to facilitate burning the fresh fuel mixture, thereby increasing the combustion efficiency. However, this results in a decrease in power output due to the exhaust efficiency being decreased. Since both the facts that the power output is increased due to the highly efficient replacement of gases and that the total hydrocarbons are decreased due to the prevention of escape of fresh fuel mixture into the exhaust port are inconsistent with each other, the improvement of the power output of the engine and the reduction in total hydrocarbons in the exhaust gases must be achieved in a balanced relation.

SUMMARY OF THE INVENTION

An object of the present invention is to provide a two-stroke cycle engine which overcomes the above-mentioned problems and improves its power output while reducing the total hydrocarbons in the exhaust gases.

This and other objects are achieved by providing a two-stroke cycle engine comprising a crank chamber in a crankcase into which a fuel mixture is supplied through an intake port, a combustion chamber in a cylinder, scavenging ports in the cylinder for communication between the combustion chamber and the crank chamber, an exhaust port in the cylinder, a piston adapted to increase or decrease the volume of the combustion chamber as it reciprocates in the cylinder and open or close the scavenging ports and the exhaust port, and a groove for communicating the exhaust port with the crank chamber via the scavenging ports when the piston is in its pre-selected stroke position where the scavenging ports and the exhaust port are closed by the piston.

During movement of the piston from its top dead center toward its bottom dead center, the scavenging ports and the exhaust port are uncovered so that a fresh fuel mixture in the crank chamber flows through the scavenging ports into the combustion chamber. The flow of the fuel mixture through the scavenging ports expels the burned gases from the combustion chamber into the exhaust port. The exhaust gases which leaves the cylinder, contain a portion of the fuel mixture passing from the scavenging ports through the combustion chamber into the exhaust port as it is and hydrocarbon remaining as the unburned gas. During movement of the piston toward the top dead center after it has passed through the bottom dead center, the piston closes the scavenging ports and the exhaust port so that it compresses the fuel mixture in the combustion chamber. With the scavenging ports and exhaust port closed, as the piston reaches its pre-selected stroke position, the exhaust port communicates through the communication groove with the scavenging ports and crank chamber so that a portion of the burned gases containing the hydrocarbon and remaining in the exhaust port is drawn through the scavenging ports into the crank chamber. As the piston reaches the top dead center, the fuel mixture in the combustion chamber is burned whereupon the presence of the portion of the burned gases in the fresh fuel mixture facilitates burning of the mixture in the combustion chamber to result in a increase in combustion efficiency. By circulating a portion of the burned gases from the exhaust port through the communication groove into the crank chamber and from the latter into the combustion chamber, the two-stroke cycle engine provides an increased power output while reducing the total amount of hydrocarbon in the exhaust gases.

In the two-stroke cycle engine according to the invention, the exhaust port and crank chamber may be communicated with each other via the scavenging ports by the communication groove when the piston reaches its top dead center.

When the exhaust port and crank chamber are communicated with each other by the communication groove, the portion of the burned gases in the exhaust port is smoothly drawn through the scavenging ports into the crank chamber under a vacuum which is created in the crank chamber by movement of the piston toward its top dead center.

The portion of the burned gases which is drawn from the exhaust port through the communication groove and the scavenging ports into the crank chamber, mostly remains in the scavenging ports. When the scavenging ports are opened, the burned gases remaining therein flow into the combustion chamber, prior to flow of the fuel mixture in the crank chamber flows into the combustion chamber. Thus, the initially escaping gases from the combustion chamber are occupied by the burned gases circulated into the combustion chamber so that the amount of the fresh fuel mixture can be reduced.

In the two-stroke cycle engine according to the invention, the communication groove may comprise grooves formed in the piston on its outer surface and extending circumferentially around the piston between the exhaust port and the scavenging ports to establish communication therebetween when the piston reaches its top dead center.

In the two-stroke cycle engine according to the invention, the passages from the exhaust port to the scavenging port may be in the form of conduits formed in the piston and opening at its ends into the exhaust port and the scavenging ports.

In the two-stroke cycle engine according to the invention, the communication groove may comprise circumferentially extending grooves formed in a piston on its outer cylindrical surface and in the inner wall of the cylinder, respectively, and adapted to open into the exhaust port and the scavenging ports, respectively. When the piston reaches its top dead center, the channels face each other to define continuous channels each opening into the exhaust port and the scavenging port.

In the two-stroke cycle engine according to the invention, the communication groove may also comprise circumferentially extending grooves formed in a piston on its outer cylindrical surface and pipes connected at their one end to the scavenging ports and adapted to open into the channels when the piston reaches its top dead center.

In the two-stroke cycle engine according to the invention, the exhaust port may be connected to a muffler having its space therein, and communicated through the muffler space with the scavenging ports and hence the crank chamber by the communication groove. Thus, the burned gases are taken from the exhaust port through the muffler, and then through the communication groove and scavenging ports and into the crank chamber. The communication groove may comprise circumferentially extending grooves formed in the piston on its outer surface and adapted to open into the scavenging ports and pipes connected at their one end to a muffler which is connected to the exhaust port, the pipes being positioned on the cylinder wall to establish communication between the channels and the inner space of the muffler when the piston reaches its top dead center.

DETAILED DESCRIPTION OF THE INVENTION

Figure 1:
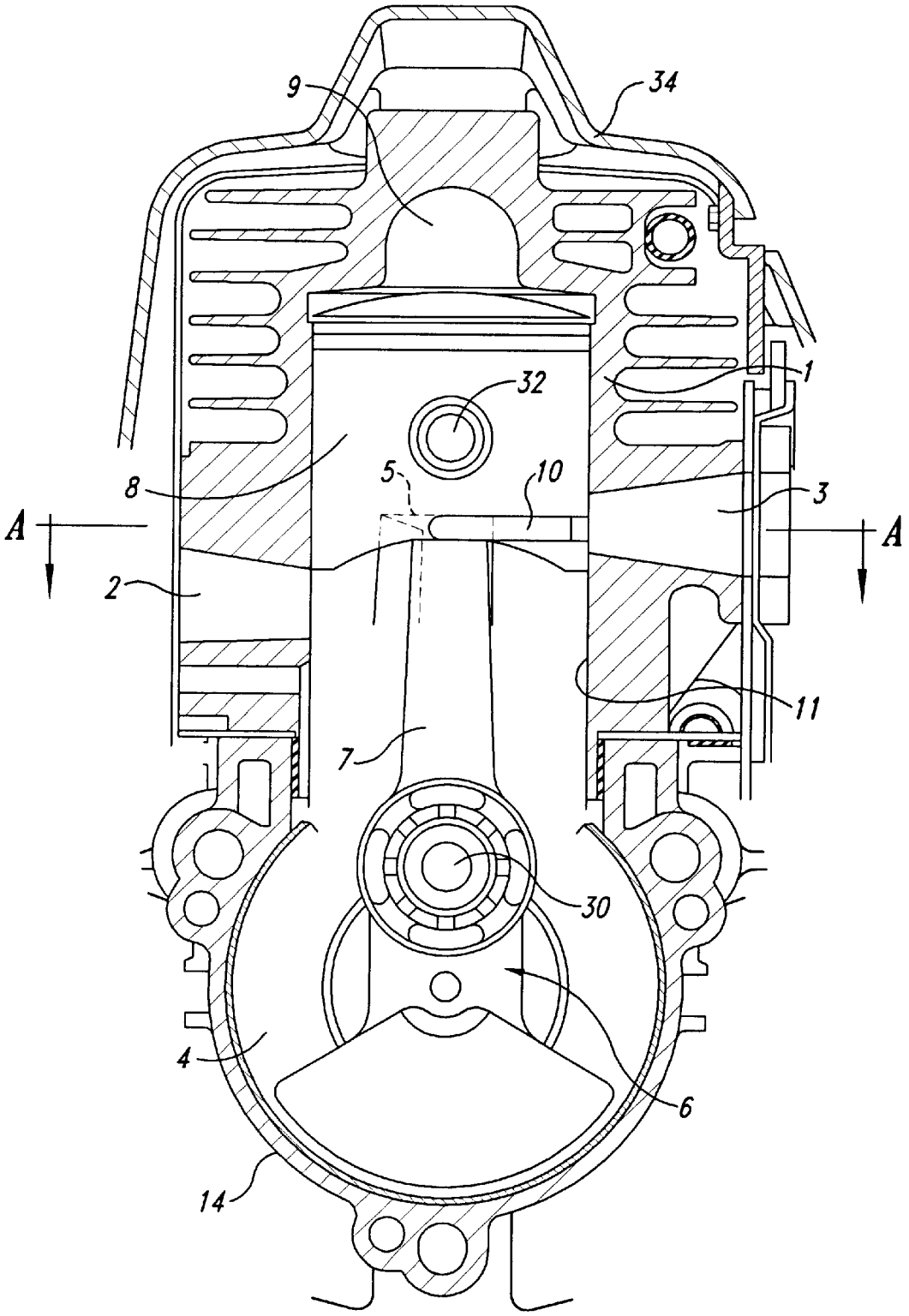
FIG. 1 is a vertical sectional view of the two-stroke cycle engine with a piston position at its top dead center.
Figure 2:
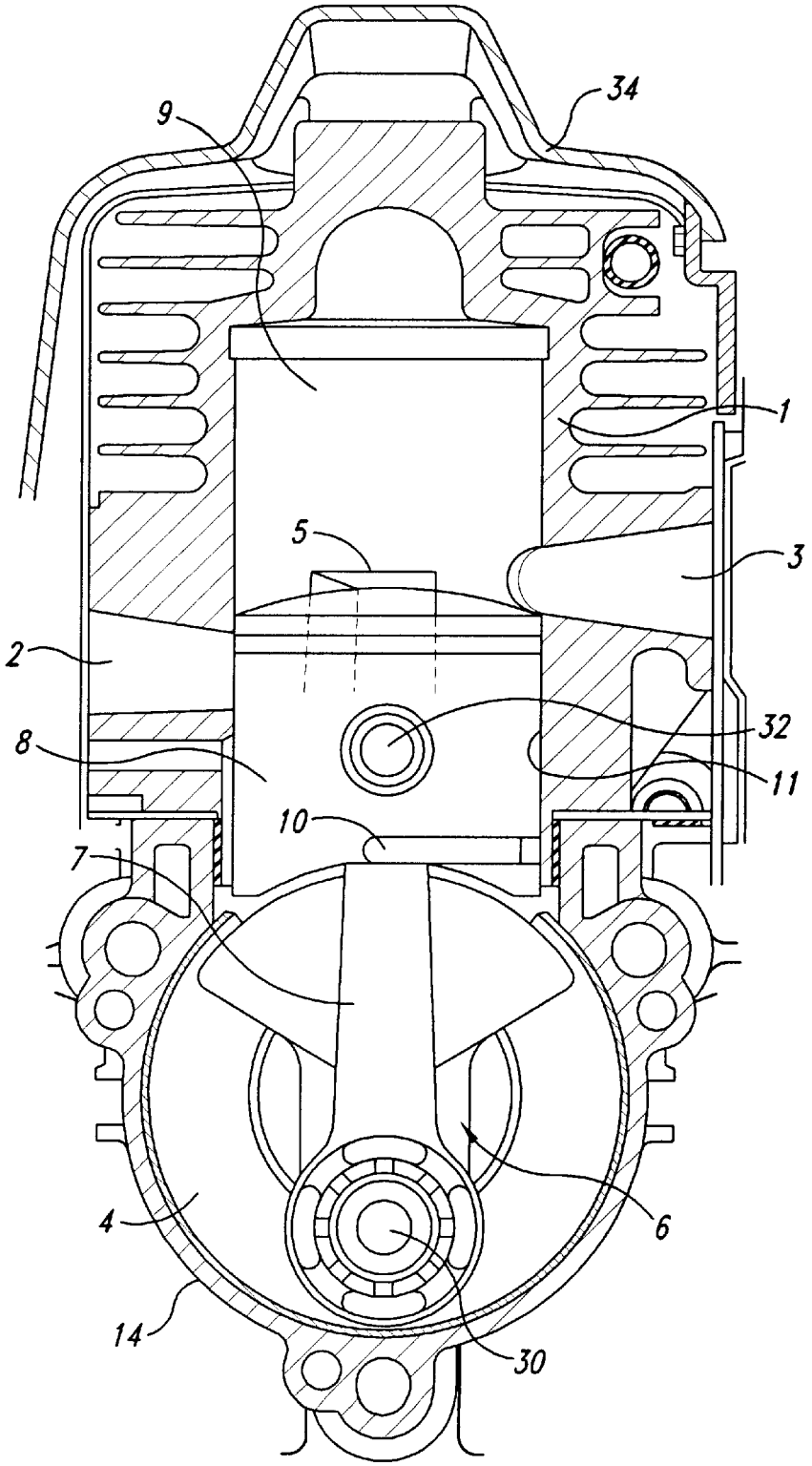
FIG. 2 is a vertical sectional view of the two-stroke cycle engine with the piston position at its bottom dead center.

Referring to the drawings, and particularly, to FIGS. 1 and 2, a two-stroke cycle engine according to the present invention comprises a cylinder 1 and a crankcase 14 joined to each other. A crankshaft 6 is rotatively supported in the crankcase 14. A piston 8 is disposed for reciprocating movement within the bore 11 of the cylinder 1. A connecting rod 7 is rotatively connected at its one end to a crank-pin 30 of the crankshaft 6 and pivotably connected at its other end to the piston 8 by means of a piston-pin 32 so that the reciprocation of the piston 8 causes the crankshaft 6 to be rotated. A combustion chamber 9 is defined by the inner wall of the cylinder 1 and the top surface of the piston 8 while a crank chamber 4 or mixture chamber is defined by the inner wall of the crankcase 14 and the bottom surface of the piston 8. Upward or downward movement of the piston 8 causes a volume of the combustion chamber 9 to be increased or decreased, correspondingly, resulting in decrease or increase in volume of the crank chamber 4. An intake port 2 is formed in the wall of the cylinder 1 and adapted to receive a fuel mixture through a carburetor (not shown). As the piston 8 moves upward or downward, it is adapted to open or close the intake port 2, thereby permitting or blocking communication with the crank chamber 4. An exhaust port 3 which is adapted to connected to a muffler (not shown), is formed in the wall of the cylinder 1 in a position spaced circumferentially of the cylinder 1 through 180 degrees from the intake port 2, at a level above the intake port 2. As the piston 8 moves upward or downward, it is adapted to open or close the exhaust ports 3, thereby permitting or blocking communication with the combustion chamber 9. Scavenging ports 5 are formed in the wall of the cylinder 1 in positions spaced circumferentially of the cylinder 1 through 90 degrees from the exhaust port 3, at a level identical to that of the exhaust port 3 such that they establish communication between the combustion chamber 9 and the crank chamber 4. The scavenging ports 5 are also spaced apart circumferentially of the cylinder from each other through 180 degrees. A spark plug (not shown) is mounted adjacent the combustion chamber. There is provided a cover 34 surrounding the exterior of the cylinder 1.

Figure 3:
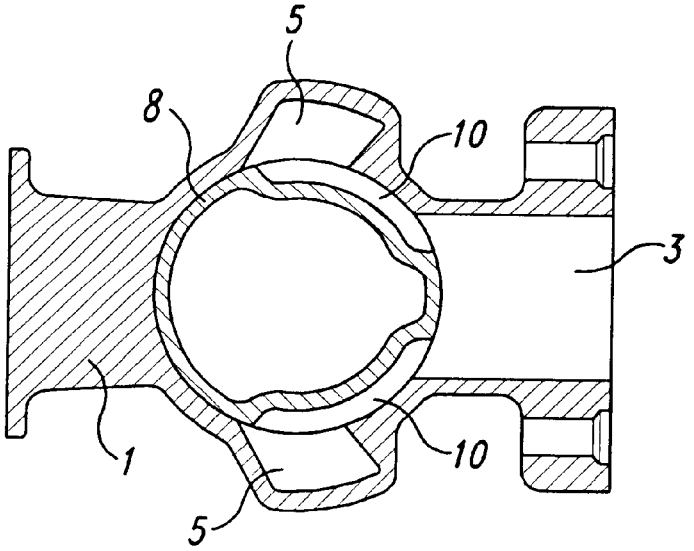
FIG. 3 is a cross-sectional view of the engine taken along line A—A of FIG. 1.

As can be seen in FIG. 3, a groove is provided for communicating the exhaust port 3 with the crank chamber 4 via the scavenging ports 5 and comprise two grooves 10 each formed in the piston 8 on its outer cylindrical surface and extending circumferentially around the piston 8 between the exhaust port 3 and each of the scavenging ports 5. The axial position of the channels 10 in the piston 8 is such that when the piston 8 reaches the top of the cylinder 1 which corresponds to the top dead center of the piston 8, each of the channels 10 and 10 opens into the exhaust port 3 and each scavenging ports 5.

Assuming that the piston 8 is in its top dead center, and the fuel mixture is compressed in the combustion chamber 9, the compressed fuel mixture is ignited by the spark plug (not shown) to produce the burning and expanding gases forcing the piston 8 to move downward. During movement of the piston from its top dead center to its bottom dead center, the volume of the combustion chamber 9 increases while the volume of the crank chamber 4 decreases for compression of the fuel mixture therein. The downward movement of the piston 8 causes the exhaust port 3 to open, thereby flowing the burned gas out of the cylinder 1 through the exhaust port 3. Subsequently, the piston 8 uncovers the scavenging ports 5 in the wall of the cylinder 1 so that the compressed fuel mixture (fresh fuel charge) is charged from the crank chamber 4 through the scavenging ports 5 into the combustion chamber 9 while expelling the burned gases from the combustion chamber into the exhaust port 3. At this point, since both the exhaust port 3 and the scavenging ports 5 open, a portion of the fresh fuel mixture which is introduced from the crank chamber 4 through the scavenging ports 5 into combustion chamber 9 may escape into the exhaust port 3. Hydrocarbons contained in the escaped fresh fuel mixture and the unburned components in the burned gases defines total hydrocarbons in the exhaust gas.

As the piston 8 moves upward past the bottom dead center, it closes the scavenging ports 5 and the exhaust port 3 so that any communication between the combustion chamber 9 and the crank chamber 4 is blocked to stop any escape of the fuel mixture. As the piston 8 continues to move from its bottom dead center to its top dead center, the piston 8 compresses the fuel mixture in the combustion chamber 9 while creating the vacuum in the crank chamber 4. The upward continuous movement of the piston 8 causes the intake port 2 to open for communication with the crank chamber 4, under the action of vacuum in which the fuel mixture from the carburetor is drawn or aspirated through the intake port 2 into the crank chamber 4. As the piston 8 reaches its top dead center, the exhaust port 3 and the scavenging ports 5 communicate with each other through the grooves 10 so that the portion of the burned gases containing the escaped fresh fuel mixture is drawn from the exhaust port 3 through the grooves 10 and the scavenging ports 5 into the crank chamber 4 under vacuum created in the crank chamber 4 to reduce the total hydrocarbons in the exhaust gas. The major portion of the burned gases drawn from the exhaust port 3 will remains in the scavenging ports 5.

After the piston 8 has passed through the top dead center, it again moves downward so that the piston 8 closes the intake port 2 and uncovers the exhaust port 3 and the scavenging ports 5 for communication with the combustion chamber 9. Thus, the burned gases remaining in the scavenging ports 5 first flow into the combustion chamber 9 and the fresh fuel mixture is then charged into the combustion chamber 9. Gases which initially escape from the combustion chamber, have a large proportion of the burned gases circulated into the combustion chamber 9 and this results in reduction in the total hydrocarbons in the exhaust gas.

Mixing the high temperature-burned gases with the fresh fuel mixture in the combustion chamber 9 facilitates burning of the fuel mixture and can thus enhance the combustion efficiency. In general, a decrease in charging efficiency of the fuel mixture results in a poor power output, but if an amount of the burned gases to be circulated into the combustion chamber is limited to such an extent that the burning of the fuel mixture is not deteriorated, the combustion efficiency can be improved without lowering the power output and the total hydrocarbons in the exhaust gases can be reduced.

Referring to FIGS. 4 through 7 illustrating alternative embodiments of the two-stroke cycle engine according to the present invention and which are views similar to FIG. 3, similar components are indicated by same reference numerals as in FIGS. 1 through 3.

Figure 4:
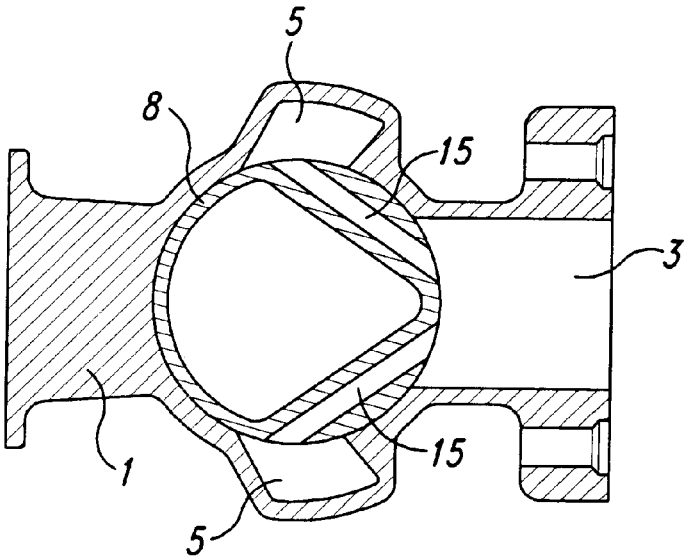
FIG. 4 is a view similar to FIG. 3 but showing another embodiment of the two-stroke cycle engine.

In the two-stroke cycle engine illustrated in FIG. 4, the passages from the exhaust port to the scavenging port are in the form of conduits 15 and 15 formed in a piston 8 such that each of the conduits 15 and 15 extends between the exhaust port 3 and each of the scavenging ports 5. The axial position of the conduits 15 in the piston 8 is such that when the piston 8 reaches the top of the cylinder 1 which corresponds to the top dead center of the piston 8, each of the conduits 15 and 15 opens at its ends into the exhaust port 3 and each scavenging port 5.

Figure 5:
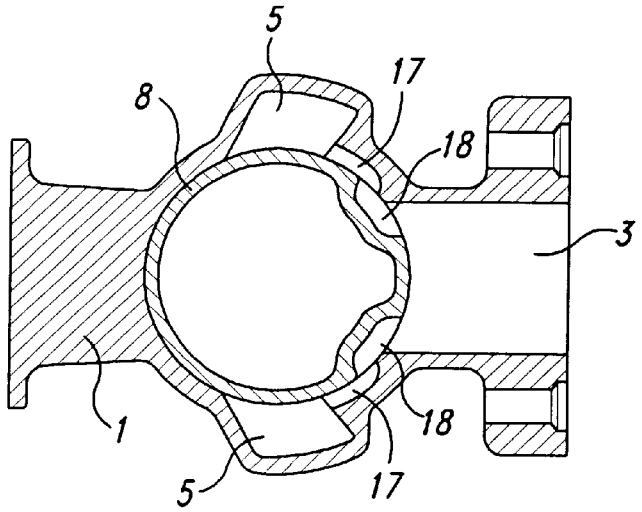
FIGS. 5 through 7 are views similar to FIG. 3 but showing further embodiments of the two-stroke cycle engine.

In the two-stroke cycle engine illustrated in FIG. 5, the communicating groove is in the form of circumferentially extending grooves 18 and 17 formed in a piston 8 on its outer cylindrical surface and in the inner wall of the cylinder 1, respectively, and adapted to open into the exhaust port 3 and the scavenging ports 5, respectively. The grooves 17 and 18 are dimensioned such that portions of the grooves 17 and 18 overlap with each other. The axial positions of the grooves 17 and 18 are such that when the piston 8 reaches the top of the cylinder 1 which corresponds to the top dead center of the piston 8, the grooves 17 and 18 face each other to define a continuous grooves opening into the exhaust port 3 and the scavenging port 5.

Figure 6:
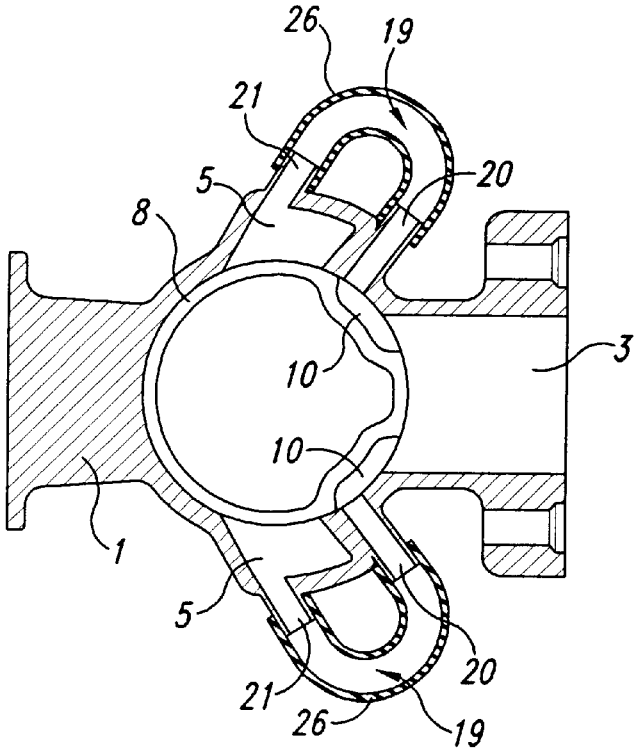

In the two-stroke cycle engine illustrated in FIG. 6, grooves 10 similar to those shown in FIG. 5, are formed in a piston 8 on its outer cylindrical surface while a cylinder wall is formed with openings 20 and 20 adapted to open into the groove 10. There is provided an opening 21 formed to communicate with each of the scavenging ports 5 and a pipe 26 is connected at its one end to the opening 20 and at its other end to the opening 21. The axial positions of the grooves 10 and the openings 20 are such that when the piston 8 reaches the top of the cylinder 1 which corresponds to the top dead center of the piston 8, the grooves 10 and the openings 20 face each other to define communication passages 19 extending through the pipes 26 between the exhaust port 3 and the scavenging ports 5 and opening into them. As the piston 8 moves to its top dead center, the burned gases in the exhaust port 3 flows through the communication passages 19 into the scavenging ports 5.

Figure 7:
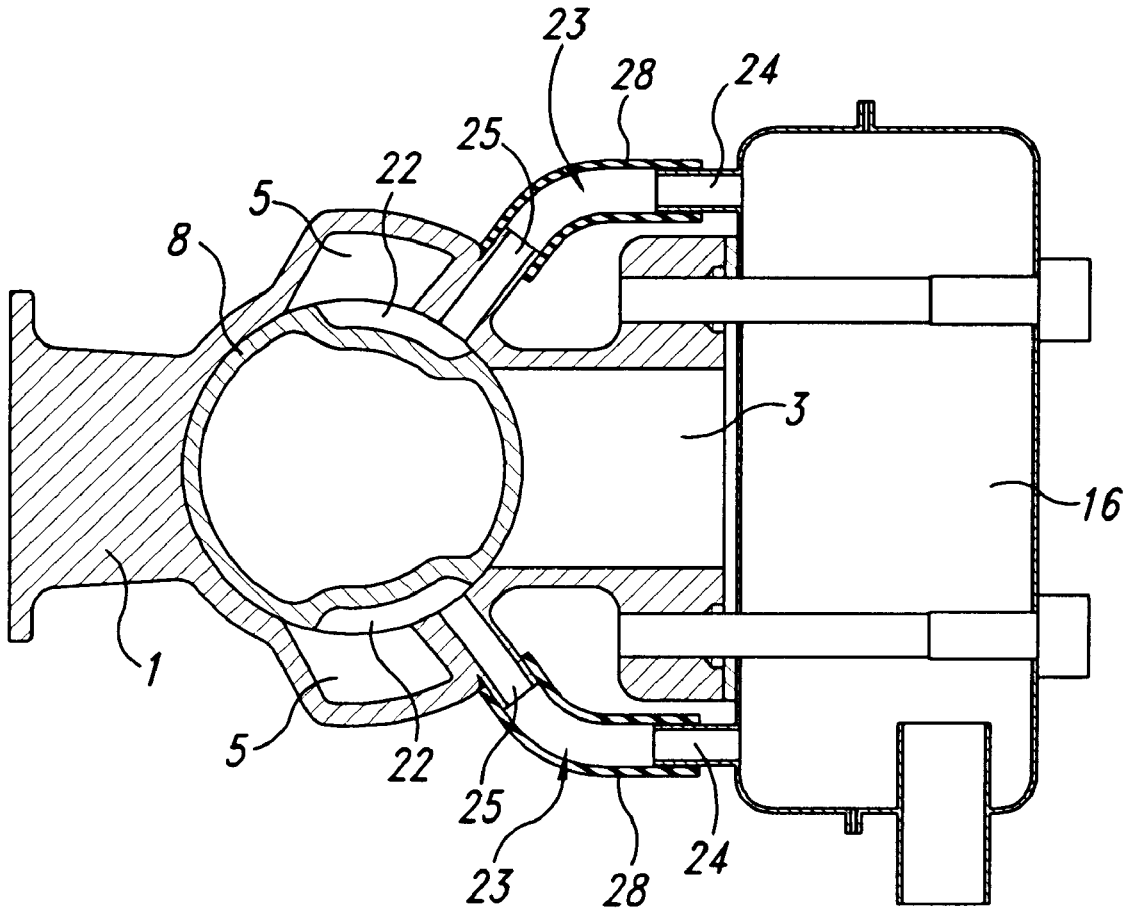

In a two-stroke cycle engine illustrated in FIG. 7, a piston 8 has formed on its outer cylindrical surface with two circumferentially extending grooves 22 each adapted to open into the scavenging port 5 while an opening 25 adapted to open into each of the grooves 22, is formed in the cylinder wall. A muffler 16 is connected to the exhaust port 3 and provided with openings 24 extending from an inner space in the muffler 16. A pipe 28 is connected between each of the openings 24 and each of the openings 25. The axial positions of the grooves 22 and the openings 25 are such that when the piston 8 reaches the top of the cylinder 1 which corresponds to the top dead center of the piston 8, the grooves 22 and the openings 25 face each other to define communication passages 23 through the pipes 26 and the muffler 16 between the exhaust port 3 and the scavenging ports 5. As the piston 8 moves to its top dead center, the burned gases in the exhaust port 3 flows through the muffler 16, communication passages 23 and the grooves 22 into the scavenging ports 5.

What is claimed is:

1. A two cycle stroke engine comprising a crank chamber in a crankcase into which a fuel mixture is supplied through an intake port, a combustion chamber in a cylinder, scavenging ports in said cylinder for communication between said combustion chamber and said crank chamber, an exhaust port in said cylinder, a piston having an outer surface and being adapted to increase or decrease the volume of said combustion chamber as it reciprocates in said cylinder and open or close said scavenging ports and said exhaust port, a communication groove formed on the piston's outer surface for communicating said exhaust port with said scavenging ports when said piston is in its pre-selected stroke position where said scavenging ports and said exhaust port are closed by said piston, and a circumferentially extending channel formed in the inner wall of said cylinder and adapted to communicate with said groove whereby when said piston reaches its pre-selected stroke position, said communication groove and said channel face each other to define a continuous passageway opening into said exhaust port and said scavenging port.

2. A two cycle stroke engine according to claim 1 wherein said exhaust port and said scavenging ports communicate with each other by said communication groove when said pre-selected stroke position of said piston is top dead center.

3. A two cycle stroke engine according to claim 1, wherein said communication groove extends circumferentially.

4. A two cycle stroke engine comprising a crank chamber in a crankcase into which a fuel mixture is supplied through an intake port, a combustion chamber in a cylinder, scavenging ports in said cylinder for communication between said combustion chamber and said crank chamber, an exhaust port in said cylinder, a piston having an outer surface and being adapted to increase or decrease the volume of said combustion chamber as it reciprocates in said cylinder and open or close said scavenging ports and said exhaust port, a communication groove formed on the piston's outer surface for communicating said exhaust port with said scavenging ports when said piston is in its pre-selected stroke position where said scavenging ports and said exhaust port are closed by said piston, and pipes connected at their one end to said scavenging ports and adapted to open into said communication groove when said piston reaches its pre-selected stroke position.

5. A two cycle stroke engine comprising a crank chamber in a crankcase into which a fuel mixture is supplied through an intake port, a combustion chamber in a cylinder, scavenging ports in said cylinder for communication between said combustion chamber and said crank chamber, an exhaust port in said cylinder, a piston having an outer surface and being adapted to increase or decrease the volume of said combustion chamber as it reciprocates in said cylinder and open or close said scavenging ports and said exhaust port, a communication groove formed on the piston's outer surface for communicating said exhaust port with said scavenging ports when said piston is in its pre-selected stroke position where said scavenging ports and said exhaust port are closed by said piston, wherein said exhaust port is connected to a muffler having its space therein, and said exhaust port communicates through said muffler space with said scavenging ports by said communication groove.

6. A two-stroke cycle engine according to claim 5, wherein said communication groove is adapted to open into said scavenging ports and pipes connected at their one end to said muffler which is connected to said exhaust port, the pipes being positioned on said cylinder wall to establish communication between said groove and the inner space of said muffler when said piston reaches its pre-selected stroke position.

* * * * *